US010923272B2

(12) United States Patent
Tan et al.

(10) Patent No.: US 10,923,272 B2
(45) Date of Patent: Feb. 16, 2021

(54) MAGNETIC FLUX LEAKAGE COMPENSATION STRUCTURE

(71) Applicants: Shandong Power Equipment Co., Ltd, Jinan (CN); STATE GRID SHANGHAI MUNICIPAL ELECTRIC POWER COMPANY, Shanghai (CN)

(72) Inventors: Chong Tan, Jinan (CN); Penghong Guo, Jinan (CN); Shijun Wang, Jinan (CN); Jidong Li, Jinan (CN); Guanghui Liu, Jinan (CN); Mingsheng Wang, Jinan (CN); Jianbin Yu, Jinan (CN); Tingting Li, Jinan (CN)

(73) Assignees: SHANDONG POWER EQUIPMENT CO., LTD., Jinan (CN); STATE GRID SHANGHAI MUNICIPAL ELECTRIC POWER CO., Shanghai (CN)

( * ) Notice: Subject to any disclaimer, the term of this patent is extended or adjusted under 35 U.S.C. 154(b) by 300 days.

(21) Appl. No.: 15/770,192

(22) PCT Filed: Nov. 15, 2017

(86) PCT No.: PCT/CN2017/111157
§ 371 (c)(1),
(2) Date: Jan. 14, 2019

(87) PCT Pub. No.: WO2018/133517
PCT Pub. Date: Jul. 26, 2018

(65) Prior Publication Data

US 2019/0172633 A1 Jun. 6, 2019

(30) Foreign Application Priority Data

Jan. 19, 2017 (CN) ..... 201710044188.3

(51) Int. Cl.
*H01F 27/34* (2006.01)
*H01F 27/30* (2006.01)
*H01F 27/26* (2006.01)

(52) U.S. Cl.
CPC ..... *H01F 27/346* (2013.01); *H01F 27/263* (2013.01); *H01F 27/30* (2013.01); *H01F 2027/348* (2013.01)

(58) Field of Classification Search
CPC ..... H01F 27/26; H01F 27/263; H01F 27/266; H01F 27/30; H01F 27/303; H01F 27/306; H01F 27/346; H01F 2027/348
(Continued)

(56) References Cited

FOREIGN PATENT DOCUMENTS

CN 201536047 U 7/2010
CN 103680855 A * 3/2014
(Continued)

OTHER PUBLICATIONS

English Translation of International Search Report in international application No. PCT/CN2017/111157, dated Feb. 22, 2018.
(Continued)

*Primary Examiner* — Tszfung J Chan
(74) *Attorney, Agent, or Firm* — Syncoda LLC; Feng Ma

(57) ABSTRACT

An embodiment provides a magnetic flux leakage compensation structure, which includes an upper clamping piece and a lower clamping piece which are electrically disconnected from side-column tension plates and electrically connected with core-column tension plates, respectively, and which are electrically connected with each other through bypass cables. According to the magnetic flux leakage compensation structure provided by the embodiment, by the bypass cables connecting the upper and lower clamping pieces, currents flowing through the side-column tension plates and cores and induced voltages caused by the mag-
(Continued)

netic flux leakage in an electric circuit may be effectively avoided.

5 Claims, 7 Drawing Sheets

(58) Field of Classification Search
USPC ..... 336/197, 210
See application file for complete search history.

(56) References Cited

FOREIGN PATENT DOCUMENTS

| | | | | |
|---|---|---|---|---|
| CN | 103680855 | A | | 3/2014 |
| CN | 103745813 | A | * | 4/2014 |
| CN | 103745813 | A | | 4/2014 |
| CN | 204407147 | U | | 6/2015 |
| CN | 106783096 | A | | 5/2017 |
| CN | 206541724 | U | | 10/2017 |
| JP | H11162752 | A | | 6/1999 |

OTHER PUBLICATIONS

International Search Report and Written Opinion in international application No. PCT/CN2017/111157, dated Feb. 22, 2018.

* cited by examiner

MAGNETIC FLUX LEAKAGE COMPENSATION STRUCTURE

CROSS-REFERENCE TO RELATED APPLICATIONS

The present application claims benefit of Chinese Patent Application No. 201710044188.3, filed on Jan. 19, 2017, the contents of which are hereby incorporated by reference in its entirety.

TECHNICAL FIELD

The invention relates to the technical field of converter transformers, and particularly to a magnetic flux leakage compensation structure.

BACKGROUND

In a general transformer, a current caused by magnetic flux leakage is very low, and thus a short-circuit ring formed by upper and lower clamping pieces, side-yoke and core-column tension plates may not incur local overheating due to the magnetic flux leakage. However, a converter transformer has a large range of on-load tap changing capability. The number of its voltage regulation leads is far more than that of an ordinary power transformer, and a magnetic field generated by the voltage regulation leads is much larger. According to the electromagnetic induction principle, an alternating current magnetic field generated by currents in voltage regulation leads of a converter transformer penetrates through structural members such as a core-column tension plate and a silicon steel sheet. Therefore, a very high local eddy current loss density is easily produced because of excessive concentration of magnetic flux leakage generated together by fundamental currents and harmonic currents on certain metallic structural members, and thus local overheating is generated, thereby influencing safe operation of a product.

SUMMARY

As for the problems, an embodiment of the invention provides a magnetic flux leakage compensation structure capable of ensuring safe operation of a converter transformer.

In order to solve the problems, the technical solution adopted by the embodiment of the invention is implemented as follows: a magnetic flux leakage compensation structure includes an upper clamping piece and a lower clamping piece which are electrically disconnected from side-column tension plates and electrically connected with core-column tension plates, respectively, and which are electrically connected with each other through bypass cables. Currents are prevented from passing through the side-column tension plates with relatively smaller sectional areas, which would cause overheat in regions of edges of side columns and edges of the clamping pieces. The upper and lower clamping pieces are connected through the bypass cables, such that the bypass cables, the upper and lower clamping pieces and the core-column tension plates form a short-circuit ring along each core window to suppress magnetic flux leakage.

Tension plate screws are arranged at upper ends of the side-column tension plates which are connected with side-column upper beams through the tension plate screws. Insulating sleeves are arranged between the tension plate screws and the side-column upper beams. An insulating plate is arranged between the side-column upper beams and an upper clamping piece web. Lower ends of the side-column tension plates are connected with a lower clamping piece web. In such a manner, the side-column tension plates are electrically disconnected from the upper and lower clamping pieces.

The bypass cables are connected with the upper clamping piece web and the lower clamping piece web through wiring blocks. The bypass cables are copper stranded wires with sectional areas of 240-300 $mm^2$, and are wrapped by 3-10 mm for insulation on single sides, and there are 3, 4 or 5 cables on each side.

Junctions of the core-column tension plates and core-column upper beams on the side where voltage regulation leads pass are current collection points caused by the magnetic flux leakage, and are easily overheated. 10-15 mm thick copper plates are arranged here to improve a heat dissipation effect.

The embodiment of the invention provides the magnetic flux leakage compensation structure. By the bypass cables connecting the upper and lower clamping pieces, currents flowing through the side-column tension plates and cores and induced voltages caused by the magnetic flux leakage in an electric circuit may be effectively avoided.

Figure 1:
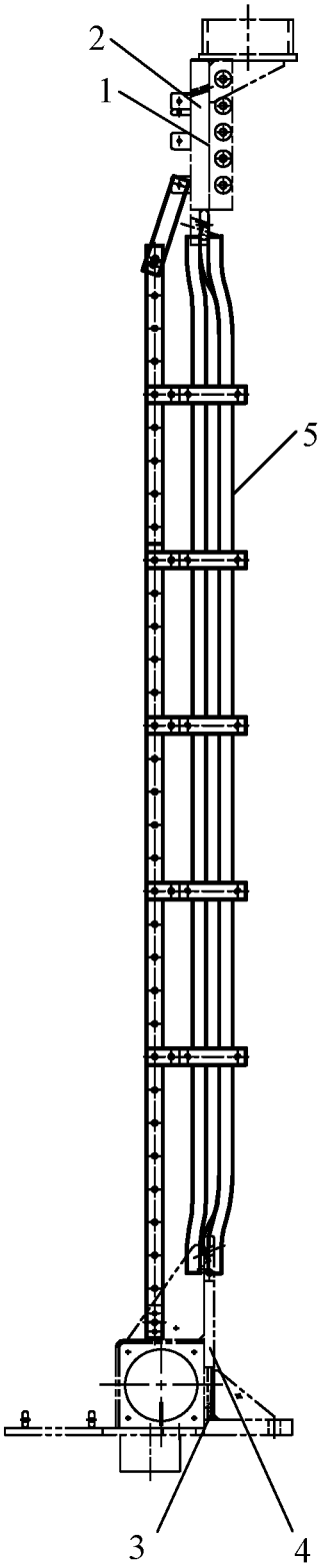
FIG. 1 is a diagram showing connections of upper and lower clamping pieces on a switch side-high-voltage side.

Reference numerals in the drawings are: 1: upper clamping piece, 2: upper clamping piece web, 3: lower clamping piece, 4: lower clamping piece web, 5: bypass cable, 6: core-column tension plate, 7: copper plate, 8: core-column upper beam, 9: side-column upper beam, 10: side-column tension plate and 11: tension plate screw.

DETAILED DESCRIPTION

Figure 2:
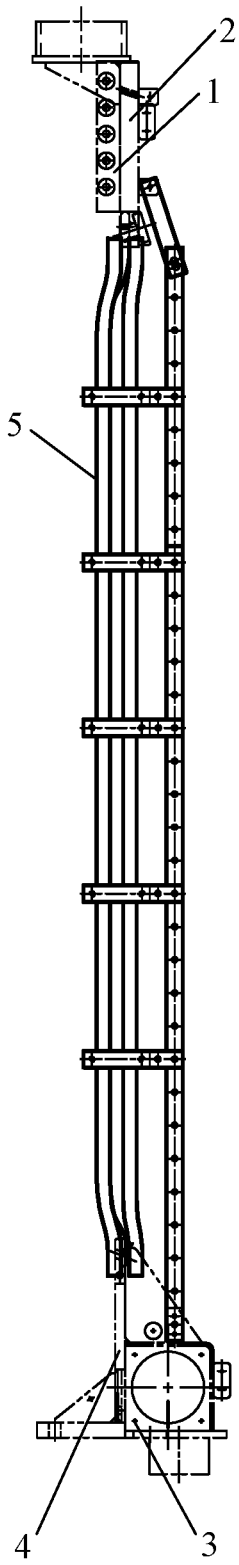
FIG. 2 is a diagram showing connections of upper and lower clamping pieces on a switch side-low-voltage side.
Figure 3:
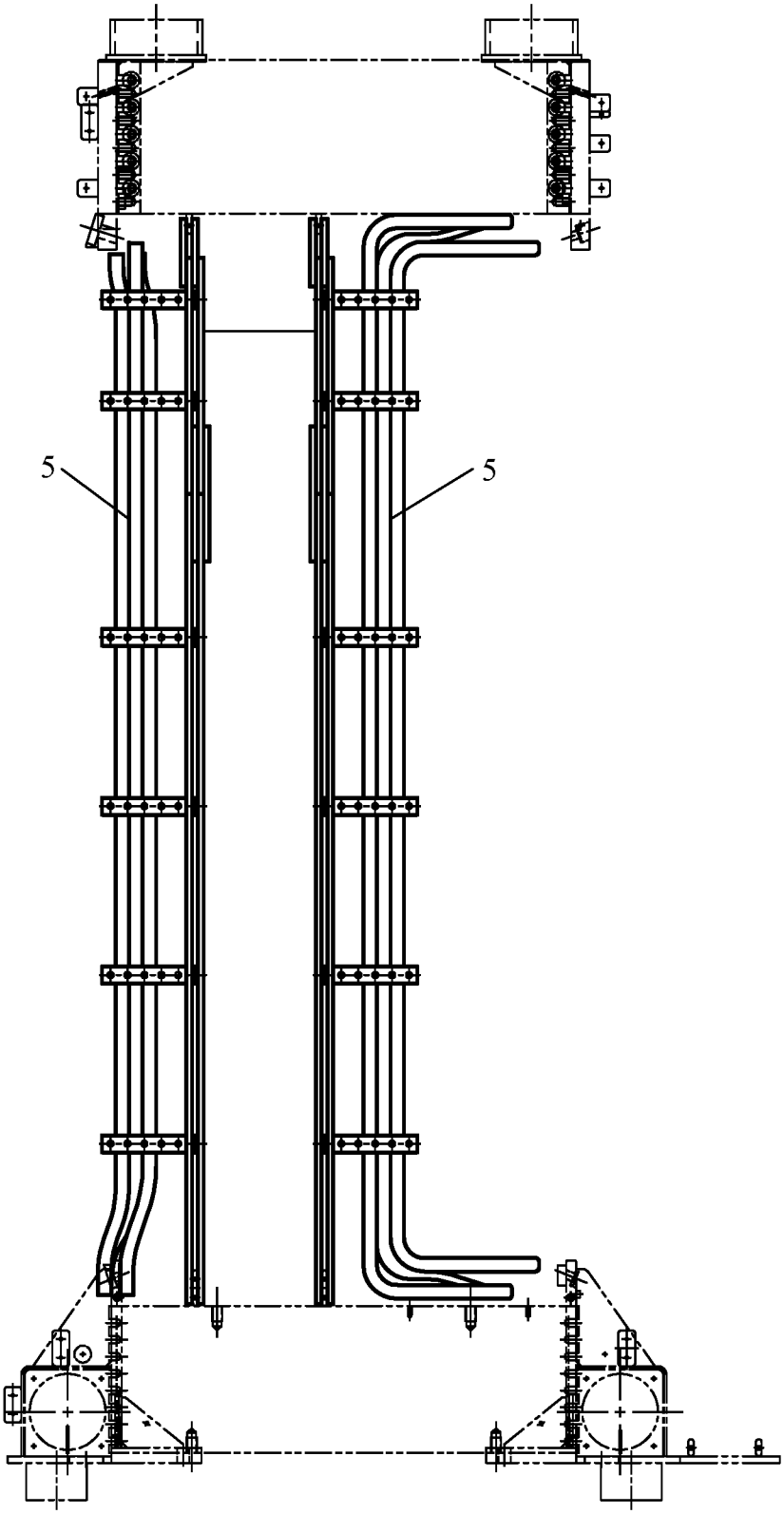
FIG. 3 is a diagram showing connections of upper and lower clamping pieces on a non-switch side.

As shown in FIG. 1 to FIG. 3, a magnetic flux leakage compensation structure includes an upper clamping piece 1 and a lower clamping piece 3, which are electrically disconnected from side-column tension plates 10 and electrically connected with core-column tension plates 6, respectively, and which are electrically connected with each other through bypass cables 5.

The bypass cables 5 are connected with an upper clamping piece web 2 and a lower clamping piece web 4 through wiring blocks. The bypass cables 5 are copper stranded wires with sectional areas of 240-300 $mm^2$, such as sectional areas of 240, 250, 270 or 300 $mm^2$. The bypass cables 5 are wrapped by 3-10 mm for insulation on single sides, such as insulation of 3 mm, 5 mm or 10 mm on single sides. There are 3, 4 or 5 cables on each side. For example, there are 3 cables on each side; there are 4 cables on each side; or there are 5 cables on each side.

Figure 4:
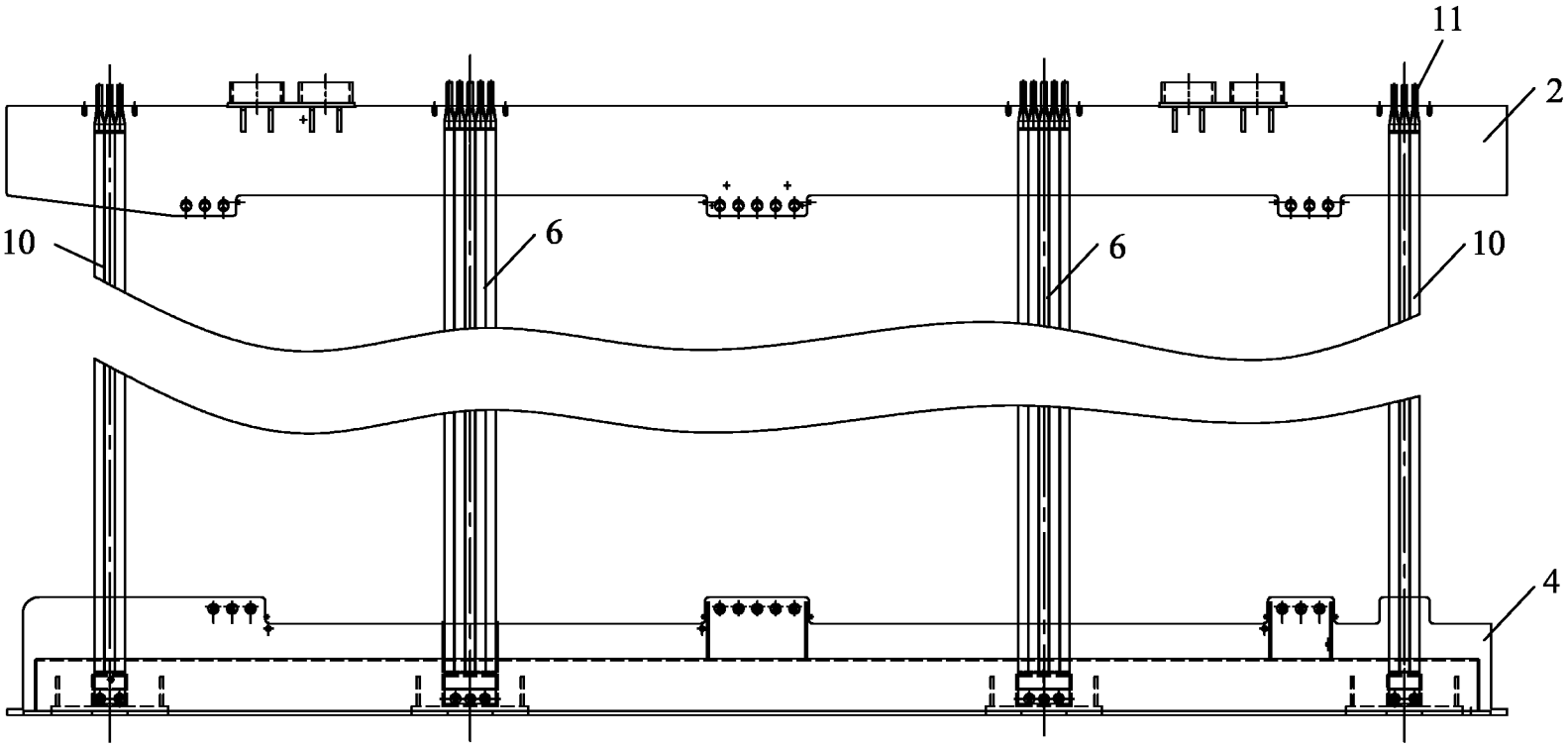
FIG. 4 is a schematic diagram of core-column tension plates and side-column tension plates.
Figure 5:
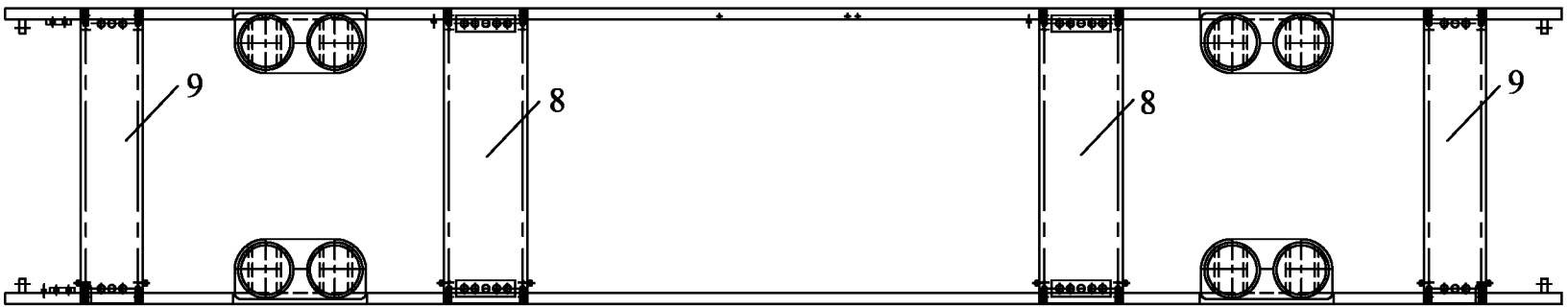
FIG. 5 is a schematic diagram of a core-column upper beam and a side-column upper beam.
Figure 6:
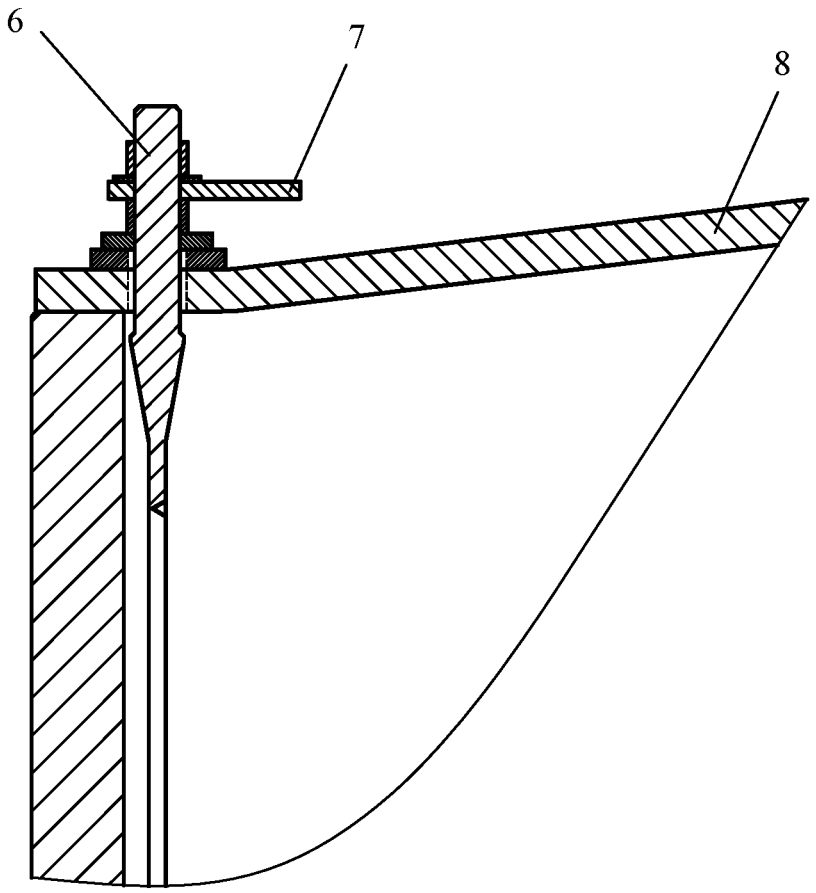
FIG. 6 is a schematic diagram of an assembled copper plate.
Figure 7:
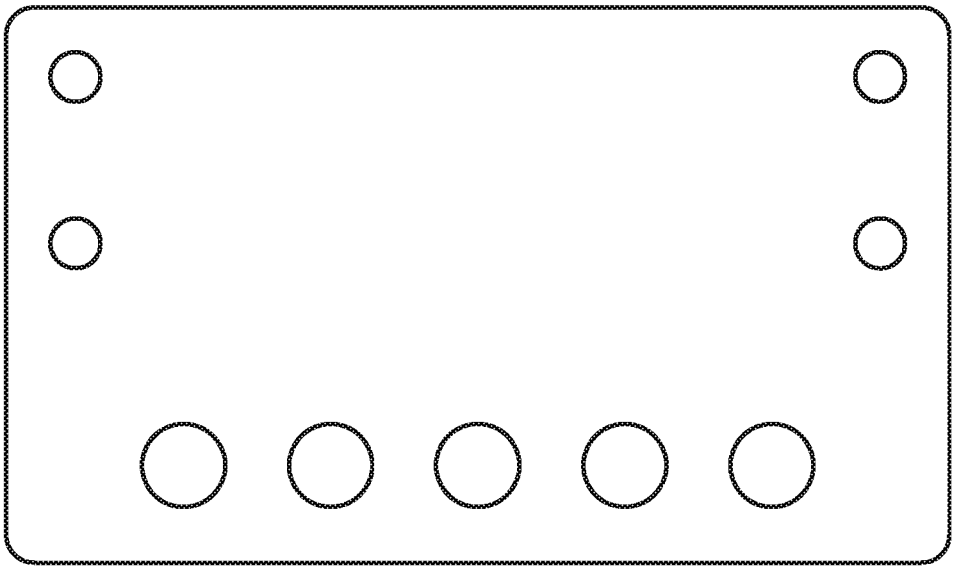
FIG. 7 is a schematic diagram of a structure of a copper plate.

As shown in FIG. 4 and FIG. 5, tension plate screws 11 are arranged at upper ends of the side-column tension plates 10 which are connected with side-column upper beams 9 through the tension plate screws 11, and insulating sleeves are arranged between the tension plate screws 11 and the side-column upper beams 9. An insulating plate is arranged between the side-column upper beams 9 and the upper clamping piece web 2. Lower ends of the side-column tension plates 10 are connected with the lower clamping piece web 4.

As shown in FIG. 6 and FIG. 7, 10-15 mm thick copper plates 7 are arranged at junctions of the core-column tension plates 6 and core-column upper beams 8 on the side where voltage regulation leads pass. For example, 10 mm thick copper plates 7 are arranged; 15 mm thick copper plates 7 are arranged; or 12 mm thick copper plates 7 are arranged.

INDUSTRIAL APPLICABILITY

According to the embodiment of the invention, by the bypass cables connecting the upper and lower clamping pieces, currents flowing through the side-column tension plates and cores and induced voltages caused by magnetic flux leakage in an electrical circuit may be effectively avoided.

The invention claimed is:

1. A magnetic flux leakage compensation structure, comprising an upper clamping piece (1) and a lower clamping piece (3), which are electrically disconnected from side-column tension plates (10) and electrically connected with core-column tension plates (6), respectively, and which are electrically connected with each other through bypass cable (5); and wherein tension plate screws (11) are arranged at upper ends of the side-column tension plates (10) which are connected with side-column upper beams (9) through the tension plate screws (11); insulating sleeves are arranged between the tension plate screws (11) and the side-column upper beams (9); an insulating plate is arranged between the side-column upper beams (9) and an upper clamping piece web (2); and lower ends of the side-column tension plates (10) are connected with a lower clamping piece web (4).

2. The magnetic flux leakage compensation structure according to claim 1, wherein the bypass cables (5) are connected with the upper clamping piece web (2) and the lower clamping piece web (4) through wiring blocks.

3. The magnetic flux leakage compensation structure according to claim 1, wherein the bypass cables (5) are copper stranded wires with sectional areas of 240-300 $mm^2$ and are wrapped by 3-10 mm for insulation on single sides, and there are 3, 4 or 5 cables on each side.

4. The magnetic flux leakage compensation structure according to claim 1, wherein copper plates (7) are arranged at junctions of the core-column tension plates (6) and core-column upper beams (8) on the side where voltage regulation leads pass.

5. The magnetic flux leakage compensation structure according to claim 4, wherein the copper plates (7) are 10-15 mm thick.

* * * * *